United States Patent [19]

Ebel

[11] 4,293,128

[45] Oct. 6, 1981

[54] CENTER OF GRAVITY-APPRAISAL BLOCK GAME

[76] Inventor: John C. Ebel, 525 Anchor Dr., Joppa, Md. 21085

[21] Appl. No.: 91,386

[22] Filed: Nov. 5, 1979

[51] Int. Cl.[3] ..... A63F 9/00

[52] U.S. Cl. ..... 273/1 GF; 46/24

[58] Field of Search ..... 273/1 R, 1 E, 1 M, 1 GF; 35/72, 22; 46/24; 404/34; 52/608; D21/102, 108; 434/302

[56] References Cited

U.S. PATENT DOCUMENTS

| | | | |
|---|---|---|---|
| 146,875 | 1/1874 | Crandall . | |
| 1,307,331 | 6/1919 | Christoph | 35/72 X |
| 2,188,043 | 1/1940 | Harrison . | |
| 2,932,745 | 1/1960 | Alberti et al. . | |
| 3,788,644 | 1/1974 | Evans | 273/1 R X |
| 3,863,918 | 2/1975 | Kramer | 273/1 R |
| 3,911,634 | 10/1975 | Horowitz . | |
| 3,919,786 | 11/1975 | Tasha . | |

*Primary Examiner*—Paul E. Shapiro
*Attorney, Agent, or Firm*—John F. McCellan, Sr.

[57] ABSTRACT

A center-of-gravity-appraisal game in the form of a set of gauge indicia-marked parallelepiped blocks for stacking by players (or teams) in alternating turns until the stack tumbles, thus designating the player (or team) represented in the previous turn as winning, or until the last remaining block has been successfully balanced on top of the stack, thereby designating the winner or winners. Certain proportions of the blocks are substantially critical for balancing purposes. In preferred embodiment each block is three units high when standing on a base or oblique face of the prism shape by two units deep between rectangular faces. Included acute angles of the bases of the prism shape or oblique faces are preferably 75.5 degrees. Width may conveniently approximate depth. The gauge indicia are parallel-spaced, preferably uniformly, and run parallel with the long dimension of the parallelogram shape and the rectangular shape of the faces of the block.

2 Claims, 5 Drawing Figures

CENTER OF GRAVITY-APPRAISAL BLOCK GAME

This invention relates generally to games and specifically to block games.

A principal object of this invention is to provide a game for a plurality of players which rewards accurate visual judgement of the center of gravity of an irregular stack of blocks in various numbers, combined with superior tactical sense and steady hand in block placement.

In the prior art various block shapes and block games have been known, including those in the following U.S. Pat. Nos. 146,875 to C. M. Crandall, 1-27-1874 shows lines on blocks; these evidently are shading lines for illustration, not actually on the blocks; 2,188,043 to J. M. Harrison, 1-23-40, discloses tapered blocks; 2,932,745 to R. Alberti et al, 1-12-60, discloses obtusely and acutely angled blocks; 3,911,634 to L. Horowitz, 10-14-75, discloses in FIG. 6 and further shows in FIGS. 8, 9 and 11, parallelogrammed hollow structures used as blocks in building; 3,919,786 to E. R. Tasha, 11-18-75, discloses tapered blocks; 3,863,918 discloses a form of balancing blocks.

However, none of the prior art disclosures is believed to provide the advantages of the present invention.

In brief summary given as cursive description and not as limitation, the invention includes a plurality of parallelepiped blocks having parallel indicia aiding critical judgment of center of gravity in stacking competition.

The above and other objects and advantages of this invention will become more readily apparent from the following description, including the drawings in which like reference numerals designate like parts:

FIGS. 1 and 2 show a typical block 10 of the preferred proportions according to this invention. All blocks are parallelepipeds, identical oblique quadrangular prisms, in shape.

Figure 1:
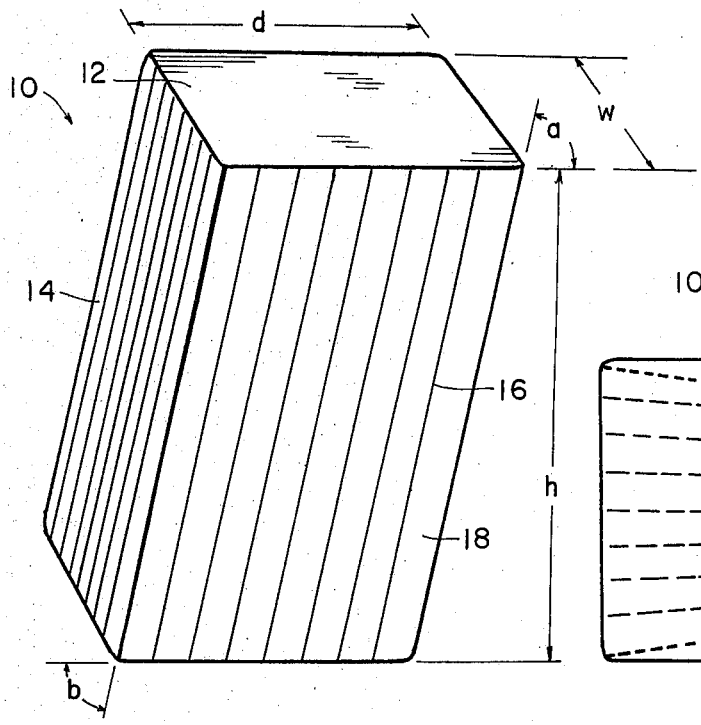
FIG. 1 is a perspective view of a block according to this invention.
Figure 2:
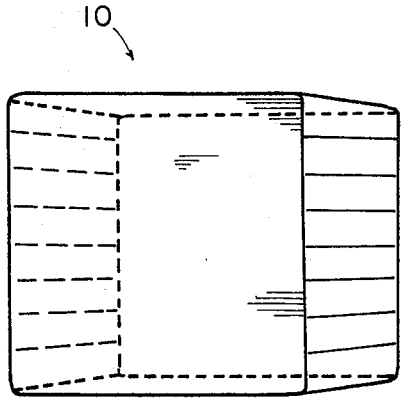
FIG. 2 is an end elevational view.

Preferably there are twelve blocks to a set. Players take turns in adding such blocks to a stack, in preferred mode resting them on the oblique faces, until a player on one side causes the stack to tumble and loses, or until the last block of the set is successfully mounted atop the stack, winning for a side. Object of each player is to produce disabling criticality of balance for the next player. Height, width, and angles of all blocks are made respectively identical for balancing purposes. Preferably the standing height h, or distance between the planes of the oblique faces 12, is three units and the depth d or perpendicular distance between rectangular faces 14 is two units. The units may conveniently be inches. Included acute angles a are preferably 75.5 degrees and the obtuse angles b are supplementary to this. Width w may conveniently approximate the depth, and for more accurate play should be in this proportion.

Parallel-spaced gauge indicia 16, in the form of colored grooves preferably, are provided and run parallel with the junctions of the rectangular faces 14 and parallelogram shaped faces 18. Preferably the indicia spacing is uniform; non-uniform spacing would tend to provide more-difficult-to-follow guidance. As will be seen, these indicia are surprisingly useful in offsetting blocks in stacking and otherwise aligning center of gravity of a block with center of gravity of a stack of blocks. They also aid in quickly identifying the orientation of a block being picked up, and add eye appeal, particularly when blocks are stacked.

Material and construction details of the blocks should be such as to provide rigidity for retention of shape in stacking, and lightness and durability to prevent damage to other objects or to the blocks themselves when falling. Preferably the material should be such as to reduce clatter when striking a tabletop or other hard surface. Solid balsa wood has proved acceptable. Thin-wall soft plastic construction or solid blocks of Styrofoam would also be suitable.

Figure 3:
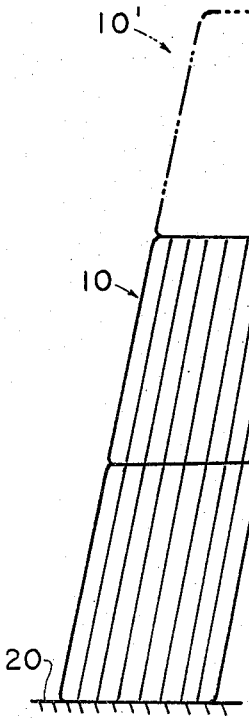
FIG. 3 is a side elevational view of a beginning stack of the blocks on a reduced scale.

FIG. 3 indicates an effect of and at the same time a criterion of the substantially critical proportions of the invention, the three-to-two proportions of height to depth and the angles of the bases of the prism shaped. Stacking any two blocks 10 on a hard level surface 20 in the preferred way on the oblique faces or prism-shape bases, as shown and with rectangular-shape sides in-place should not cause the blocks to fall. When a third block 10' (phantom lines) is stacked with ends in-place with the other two, it should, and will if the blocks are properly made, cause the stack to tip and fall.

Because of the shape of the blocks, numbers of fascinating but very simple variations in play are possible.

Figure 4:
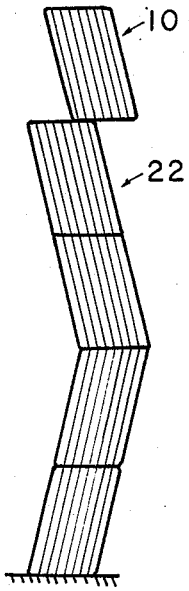
FIG. 4 is a side elevational view of a partial stack of the blocks on a reduced scale.

FIG. 4 shows a partial stack 22 in which the individual blocks 10 have been successfully oriented but kept in-plane at each stage, some end aligned, some not.

Although the reason may not be fully understood, these indicia 16, which are all inclined with the vertical, afford a surprising help judging and aligning center of gravity of a block with that of a stack, enabling novices to compete with practiced players.

Figure 5:
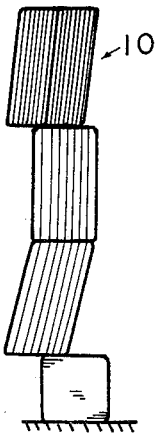
FIG. 5 is an elevational view of an alternative stacking arrangement on a reduced scale.

FIG. 5 illustrates stacking under rules in which the blocks are not required to be kept in-plane.

BASIC RULES

According to the basic rules this is an elegantly simple game of skill and daring for two or more players who alternately stack blocks upright until stack is toppled or completed. In either case a point is scored till someone gets two (each "case" constituting a round).

At start, establish an Order of Turn. In a two players game, loser of a round decides who'll go first in next round. If three or more are playing, all follow in turn between rounds.

THE PLAY—One block is placed (upright) in center of play area. Player No. 1 sets a block on top, then Player No. 2, and so on to end of round.

SCORING—If stack is toppled, preceding player gets a point; if completed, player adding 12th block gets a point.

The game is best played on a coffee table (or other low surface) because skillful play depends upon accurately judging center of gravity of the stack by viewing it straight down through the top so as to add a block just enough "off-center" to make the stack that much more precarious without toppling it yourself.

A longer version would be a "process of elimination" game requiring a score sheet listing players in order of turn (1st player at top), and divided into columns representing rounds.

When someone topples stack, he gets an X.

If someone completes stack, everyone else gets an X.

Three X's and you're out.

ALTERNATIVE RULES

Another version of the game is even more challenging: reversing the regular procedure by adding the stack to a remaining block. Here each player would be required to lift the stack and set it upon a base block. He may, of course, use both hands: one to grasp the bottom block and the other to "hold" the top block so as to steady the stack as gently as he can—else he will cause it to buckle at its weakest (off-center) point.

Scoring follows the same pattern: one point for the player who sets the stack on the last remaining block, and one point for the preceeding player should the transfer attempt fail. Or, in the longer playing game of "three X's and you're out", player or team failing to make the transfer gets an X, and when a player or team completes the round, the other players or team(s) get an X. Also, player or team losing the round has choice of being the 1st, 2nd, 3rd, 4th, 5th, or 6th player at turn in next round (a choice influenced by the previously established order of turn; the number of players in a no-teams game; the number of teams and their numerical consist; and whether or not the losing player relishes the extra challenge shouldered by the slated final player).

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In game apparatus employing a plurality of blocks for balancing, the improvement comprising: all said blocks being respective identical oblique quandrangular prisms in shape; the proportions of each block being such as to permit stacking first and second of said blocks on the oblique faces thereof with the rectangular shape faces in-plane, without tipping over, but such as to cause tipping over of the stack when a third said block is added to the top of said stack with the rectangular shape faces thereof in-plane with those of the first and second blocks, a plurality of parallel-spaced indicia on each block parallel with one or more faces thereof but vertically inclined, said parallel spacing of the indicia being uniform; said proportions of each block being as follows: the ratio of the standing height to the perpendicular distance between rectangular faces being three-to-two, and the acute angles of the bases of the prism shape being substantially 75.5 degrees.

2. The method of playing a balancing game consisting of the steps:

a. forming a stack of a plurality of identical blocks of oblique quandrangular prism shape;

b. lifting the stack by the lowermost block thereof; and c. depositing the stack upon a single said block in balance preventing the stack from toppling over; thereby playing said balancing game.

* * * * *